US007364790B2

(12) United States Patent
Avazzeri et al.

(10) Patent No.: US 7,364,790 B2
(45) Date of Patent: Apr. 29, 2008

(54) HIGHLY-OPAQUE LAYERED SHEET AND THE PRODUCTION METHOD THEREOF

(75) Inventors: Laurence Avazzeri, Besse sur Braye (FR); Jérôme Bordeau, La Chartre sur le Loir (FR)

(73) Assignee: ARJO Wiggins Papiers Couches, Issy les Moulineaux (FR)

( * ) Notice: Subject to any disclaimer, the term of this patent is extended or adjusted under 35 U.S.C. 154(b) by 124 days.

(21) Appl. No.: 10/502,446

(22) PCT Filed: Jan. 21, 2003

(86) PCT No.: PCT/FR03/00182

§ 371 (c)(1),
(2), (4) Date: Mar. 16, 2005

(87) PCT Pub. No.: WO03/062529

PCT Pub. Date: Jul. 31, 2003

(65) Prior Publication Data

US 2005/0158570 A1 Jul. 21, 2005

(30) Foreign Application Priority Data

Jan. 25, 2002 (FR) ..... 02 00948

(51) Int. Cl.
*B32B 5/16* (2006.01)

(52) U.S. Cl. ..... 428/323; 428/326; 428/327; 428/328; 428/329; 428/537.5; 427/324; 427/326

(58) Field of Classification Search ..... 428/323, 428/326, 327, 328, 329, 537.5; 427/324, 427/326

See application file for complete search history.

(56) References Cited

U.S. PATENT DOCUMENTS 3,839,074 A * 10/1974 Taylor ..... 428/510
5,654,050 A * 8/1997 Whalen-Shaw

FOREIGN PATENT DOCUMENTS

| | | | |
|---|---|---|---|
| EP | 0 441 694 | * | 8/1991 |
| GB | 1427485 | * | 3/1973 |
| GB | 1 427 485 | * | 3/1976 |

OTHER PUBLICATIONS

Abstract of JP54 147033, dated Nov. 16, 1979, Database WPI, Derwent Publication LTD., No. XP-002215655. Cited in the int'l. search report.*

* cited by examiner

*Primary Examiner*—Leszek Kiliman
(74) *Attorney, Agent, or Firm*—Westerman, Hattori, Daniels & Adrian, LLP.

(57) ABSTRACT

This invention relates to an ultra opaque coated sheet, characterized by the fact that it comprises a colored support made from a single ply of material, the said support being coated on at least one of its faces with one or more white pigmented coats.

Figure 1:
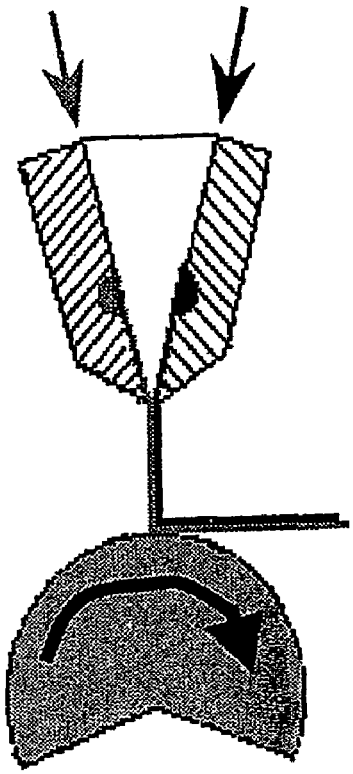

This invention also relates to the manufacturing process of this ultra opaque coated sheet.

18 Claims, 1 Drawing Sheet

HIGHLY-OPAQUE LAYERED SHEET AND THE PRODUCTION METHOD THEREOF

This invention relates to ultra opaque coated sheets and their manufacturing process.

Ultra opaque coated sheets are used frequently in various applications for which the sheets must be printable and for which it is essential that the opacity of said sheets be much higher than the opacity of conventional coated sheets with a comparable weight per square meter.

Thus, ultra opaque sheets are known that are made by coating, traditionally using air-knife coaters, trailing-blade coaters or metering-bar coaters, at least one of the two faces of a three-ply paper support, preferably a three-ply support in which the central ply with a grey paper composition introduces ultra opacity by absorption of light, and is surrounded by two plies with a white paper composition such that the assembly of each white ply supporting one or more white coats makes the ultra opaque sheet look white and uniform.

One disadvantage of this technique is the difficult and expensive use of a multi-ply machine, particularly for manufacturing low grammage paper.

Ultra opaque sheets are also known that are made by at least two plies of white coated paper pasted to each other using a black glue and in which ultra opacity is once again provided by absorption of light due to the black colour, while maintaining a white and uniform visual appearance.

This technique has the disadvantage that it uses pasting, often a difficult step due to the choice and quantity of glue to be used, which does not allow high manufacturing speeds and can sometimes cause assembly defects between the paper plies.

Therefore one of the purposes of the invention is to provide ultra opaque sheets that can be made at minimum cost, at high manufacturing speeds and without the manufacturing constraints of prior art.

Another purpose of the invention is to provide ultra opaque sheets with a very good surface condition.

In particular, the Applicant proposes to use the most widespread production equipment, particularly single ply paper machines, and to reduce the number of manufacturing steps, particularly the pasting step.

After seeing these considerations, the Applicant made an effort to provide an opacifying base support from a single ply of coloured material onto which one or more white coats are applied on at least one of the faces.

The coloured support is intended to block the passage of light, which is an essential condition for obtaining the required opacity.

The intensity and the hue of the support colour depend on the final application and the required opacity by light absorption: preferably, the colour of the base support will be more or less grey, more or less black.

Therefore the coloured single ply according to the invention is coated on one or two faces depending on the final applications, so as to provide a white and uniform visual appearance and good printability.

The Applicant has used modern coating methods in the paper industry, to achieve uniformity in surface application, which is a necessary condition for obtaining good opacity and a good final print rendering.

While many attempts are being made to cover a coloured support with one or more white coats, particularly using the widespread air-knife coating or steel knife coating processes leading to products with a not entirely uniform visual appearance, the Applicant has discovered that a coating process that has only been used marginally up to now in paper industry, namely curtain coating, can be used to make the required ultra opaque sheets with uniform appearance.

The Applicant has also observed that this process reduces the quantity of colouring agent necessary to obtain the said opacifying effect.

The curtain coating process is a predosed coating method used in the photography industry for more than 20 years. This technology was developed for photographic films that require the deposit of many different coats, usually between 8 and 10, with severe constraints on the surface condition and also the thickness of applied coats.

The curtain coating process is based on free flow on a surface from a coating head located above the surface to be coated at a height varying between 10 and 25 cm.

The coating head is defined using properties of the coating fluid, so as to obtain the most uniform possible coating film thickness in the running direction or the transverse direction of the machine.

Figure 2:
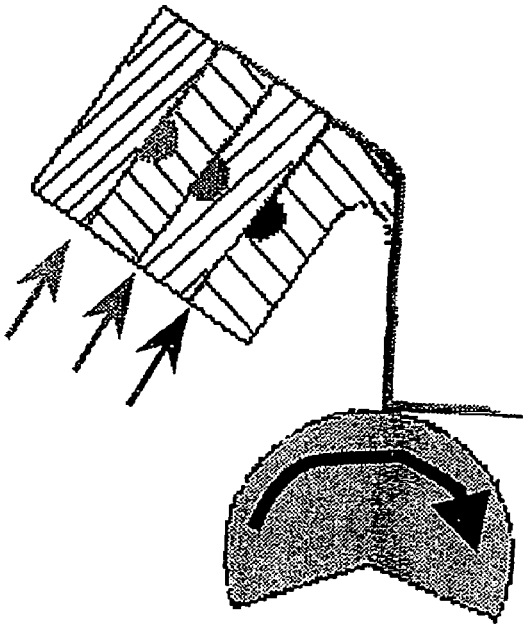

Two types of coating heads are usually used: heads with slits and heads with a sliding surface, as represented in FIGS. 1 and 2 respectively.

One of the advantages of curtain coating is the possibility of applying two or more coats simultaneously.

In practice, heads with slits are limited to a maximum of 2 or 3 coats due to their configuration, while the maximum number of coats deposited simultaneously in a sliding surface can be more than 10.

Another advantage is the lack of contact between the coating head and the support, unlike knife coating.

This provides a means of eliminating forces applied on the support during coating, which causes machine breakage and particularly has a non-negligible effect on the increase in the machine speed, and consequently can reduce production costs.

Therefore, the purpose of the invention is an ultra opaque coated sheet composed of a coloured support made from a single ply of material, the said support being coated on at least one of its faces by one or several white or light pigmented coats.

The term pigmented coats means compositions (mainly including pigments and binders) frequently used for coated printing—writing paper. The number, exact composition and weight per square meter depend on the final application of the ultra opaque sheet.

According to one particular embodiment of the invention, the sheet has an ultra opacity index of more than 92, and advantageously more than or equal to 94 in the case in which its grammage is less than 300 g/m$^2$ and its ultra opacity index is more than 94, and advantageously more than or equal to 98 if its grammage is greater than or equal to 300 g/m$^2$.

The ultra opacity index will be explained further in the presentation of the invention.

According to another particular embodiment of the invention, the whiteness of the sheet measured according to the standard ISO 11475 is more than 75, and preferably greater than or equal to 78.

According to one preferred embodiment of the invention, the single ply of material is a paper based on cellulose fibres.

According to another variant of the invention, the single ply is a coloured plastic film or a plastic film with a coloured opacifying precoat.

The weight per square meter of the paper or plastic single ply is directly dependent on the application. It is between 50 and 500 g/m$^2$.

Another purpose of the invention is a process for making a previously defined sheet in which the first step is a coloured support made from a single ply of material, and this support is then coated on at least one of its faces with one or several white pigmented coats.

According to one advantageous embodiment of the invention, the deposit of the white pigmented coat(s) is made using a curtain coating head.

According to one particular embodiment of the invention, the opacifying colouring is obtained by incorporating opacifying pigments in the bulk of a paper ply.

According to another particular embodiment of the invention, the opacifying colouring is obtained by depositing a precoat of opacifying pigments on the surface of a paper ply either using a size press or using a coating device, particularly a curtain coating head, and preferably simultaneously using the same curtain coating head as during surface application of the white pigmented coat(s).

According to another particular embodiment of the invention, the material single ply is a coloured plastic film or a plastic film covered by a coloured opacifying precoat.

According to one advantageous embodiment of the invention, the colouring material used is carbon black.

The invention also relates to the ultra opaque playing card obtained using the previously defined process or using an ultra opaque coated sheet defined above as its base.

Although the main purpose of the invention is white ultra opaque sheets, the invention could be extended to include the preparation of slightly coloured or pastel opaque sheets for which the only modifications that have to be made are applicable to the coating pigment and not to the essential elements of the invention.

The following comparative examples and their final applications illustrate the invention.

Due to their applications, ultra opaque coated sheets according to the invention are too opaque for light transmission to be determined using commercially available spectrophotometers. To overcome this difficulty and to achieve significant, reproducible measurements representative of visual observations when backlit by more or less intense natural or artificial light, the applicant has developed the following measurement system: an incident light source is composed of an incandescent filament lamp, a transparent glass bulb, marketed by Philips under reference 60 W-220V. The coated sheet for which the opacity is to be determined is placed between and in contact with a) on the light source side, a 12 millimetre diameter diaphragm and b) on the opposite side, a 20 millimetre diameter sensor of a luxmeter marketed by Gossen under the Mavolux Digital reference. The distance between the luxmeter sensor centred on the diaphragm and the light source is adjusted before starting such that if the coated sheet is not present, the value read in direct incident light is 14000 lux and the value L in lux of light transmitted in the presence of the coated sheet is recorded. The opacity of this sheet can then be quantified by an "ultra opacity index" defined by the formula:

$$\text{Ultra opacity index}=100\times(1-L/14000)$$

For illustrative purposes, traditional white-coated paper, in other words non-ultra opaque paper, has ultra opacity indexes according to this method of the order of 77 for a paper weighing 130 grams per square meter, and of the order of 94 for a paper weighing 300 grams per square meter.

The uniformity of the visual appearance of the surface of the different sheets is evaluated using the Kheops instrument marketed by Techpap. This instrument uses a CCD camera and makes an image analysis of the colour differences and brightness differences on the surface and gives a global value that is lower when the uniformity is high.

The surface whiteness of the different sheets is measured according to standard ISO 11475 in the lack of ultraviolet illumination.

COMPARATIVE EXAMPLES 1A, 1C AND EXAMPLE 1B ACCORDING TO THE INVENTION FOR A PRINTING—WRITING APPLICATION

Example 1a

An ultra opaque sheet 1a according to prior art is composed of a two-ply paper machine support paper, in which one of the plies has a grey paper composition to provide opacity and the other is a white paper composition; this two-ply, on the outside face of the hite ply, is coated with a white pigmented coat, a mix of 90% calcium carbonate and 10% styrene butadiene latex, using a steel knife process, to provide a surface condition on the said sheet 1a necessary for printing—writing on the coated sheet.

Example 1b

An ultra opaque sheet according to the invention 1b, with a weight per square meter similar to sheet 1a, is made from a grey single ply paper with a weight per square meter equal to 100 g/m$^2$, in which the opacifying colouring in this case is provided by the curtain coating process in the form of a precoat on each face equal to 10 grams per square meter, the said coat comprising 0.05 parts of carbon black dry weight for 100 parts of a mix of 90% calcium carbonate and 10% styrene butadiene latex.

This coloured single ply is then coated, still using the curtain coating process, on each of its two faces by 10 grams per square meter of a white pigmented coat identical to that used in example 1a.

Example 1c

Another ultra opaque sheet 1c, not complying with the invention, is made by steel blade coating of the coloured single ply in sheet 1b, with 10 grams per square meter on each face of the same white pigmented printing—writing coat as sheet 1b.

The optical characteristics of the three sheets are compared in table 1

TABLE 1

| | Sheet | | |
|---|---|---|---|
| | 1a | 1b | 1c |
| Grammage (in g/m2) | 130 | 120 | 120 |
| Ultra opacity index | 91 | 94 | 92 |
| Whiteness | 75 | 78 | 75 |
| Uniformity | 2.4 | 1.5 | 5.8 |

Although the weight per square meter of sheet 1b according to the invention is slightly lower, it is more ultra opaque, whiter and its surface condition is more uniform than the sheets according to prior art made using a more complex (two-ply) industrial process.

The surface of the single ply sheet 1c made with a coating using the steel knife process is not sufficiently uniform.

COMPARATIVE EXAMPLE 2A AND EXAMPLE 2B ACCORDING TO THE INVENTION FOR A PLAYING CARD APPLICATION

Example 2a

An ultra opaque sheet according to prior art 2a is composed of two plies of white coated paper pasted with a black glue weighing 0.24 grams per square meter of carbon black, by dry weight.

Example 2b

An ultra opaque sheet according to the invention 2b, with exactly the same weight per square meter as sheet 2a, is made from a grey-black single ply paper with weight per square meter equal to 240 grams, and in which the opacifying colouring is provided as in example 1b by a precoat of 5 grams per square meter on each face, the said coat containing 0.5 part of carbon black by dry weight for 100 parts of a mix identical to that used in example 1b.

This coloured single ply is then coated, still using the curtain coating process, on each of its two faces by 30 grams per square meter of a white pigmented coat identical to that used in example 1b.

The optical characteristics of the two sheets are compared in table 2

TABLE 2

| | Sheet | |
|---|---|---|
| | 2a | 2b |
| Grammage (in g/m$^2$) | 300 | 300 |
| Including weight of opacifying black per square meter (in g) | 0.24 | 0.05 |
| Ultra opacity index | 99 | 98 |
| Whiteness | 79 | 78 |
| Uniformity | 1.4 | 1.6 |

Sheet 2b according to the invention, made without an additional pasting step, has the same surface quality (whiteness, uniformity) as sheet 2a according to prior art.

These two sheets also have the same ultra opacity, but the necessary quantity of black is much lower for sheet 2b, which has an appreciable economic advantage from the points of view of material cost and recycling possibilities.

The invention claimed is:

1. Ultra opaque coated printable sheet, which comprises a coloured opaque support made from a single ply of paper based on cellulose fibers, said support being coated on at least one of its faces with one or more white pigmented coats such that said printable sheet has at least one of (i) an ultra opacity index of more than or equal to 94 and a grammage of less than 300 g/m$^2$, and (ii) and ultra opacity index of more than or equal to 98 and a grammage greater than or equal to 300 g/m$^2$.

2. Sheet according to claim 1, which has an ultra opacity index of more than 94.

3. Sheet according to claim 1, wherein its whiteness measured according to standard ISO 11475 is more than 75.

4. Sheet according to claim 1, wherein the single ply of paper comprises coloured opacifying pigments in bulk.

5. Sheet according to claim 1, wherein the single ply of paper is covered by a precoat of coloured opacifying pigments.

6. Process for manufacturing a sheet according to claim 1, wherein at first a coloured opaque support is made from a single ply of paper based on cellulose fibers, and this support is then coated on at least one of its faces with one or several white pigmented coatings such that said sheet is a printable sheet having at least one of (i) an ultra opacity index of more than or equal to 94 and a grammage of less than 300 g/m$^2$, and (ii) an ultra opacity index of more than or equal to 98 and a grammage greater than or equal to 300 g/m$^2$.

7. Process according to claim 6, wherein the deposit of the white pigmented coat(s) is made using a curtain coating head.

8. Process according to claim 6, wherein opacification is obtained by incorporating opacifying pigments in the paper bulk.

9. Process according to claim 6, wherein opacification is obtained by depositing a precoat of opacifying pigments either using a size press or using a coating device, on the paper surface.

10. Process according to claim 9, wherein the coating device used to deposit the precoat of opacifying pigments is a curtain coating head.

11. Process according to claim 6, wherein the sheet has an ultra opacity index of more than 94.

12. Process according to claim 6, wherein the opacifying colouring material used is carbon black.

13. Ultra opaque playing card obtained by the process according to claim 6.

14. Sheet according to claim 2, which has an ultra opacity index of more than or equal to 94 and a grammage of less than 300 g/m$^2$.

15. Sheet according to claim 2, which has an ultra opacity index of more than or equal to 98 and a grammage greater than or equal to 300 g/m$^2$.

16. Sheet according to claim 3, wherein its whiteness measured according to standard ISO 11475 is greater than or equal to 78.

17. Process according to claim 10, wherein the deposit of the white pigmented coat(s) is made using a curtain coating head.

18. Ultra opaque playing card obtained using a sheet defined according to claim 1, as its base.

* * * * *